US007711277B2

(12) United States Patent
Ahn et al.

(10) Patent No.: US 7,711,277 B2
(45) Date of Patent: May 4, 2010

(54) TONER DENSITY ESTIMATING METHOD AND APPARATUS USING TONER IMAGE AND TONER SUPPLYING METHOD AND APPARATUS

(75) Inventors: Myung-kook Ahn, Suwon-si (KR); Kyu-cheol Shin, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 650 days.

(21) Appl. No.: 11/638,459

(22) Filed: Dec. 14, 2006

(65) Prior Publication Data

US 2008/0025738 A1 Jan. 31, 2008

(30) Foreign Application Priority Data

Jul. 31, 2006 (KR) ..... 10-2006-0072252

(51) Int. Cl.
*G03G 15/00* (2006.01)

(52) U.S. Cl. ..... 399/49; 399/60

(58) Field of Classification Search ..... 399/60, 399/49, 58, 27
See application file for complete search history.

(56) References Cited

U.S. PATENT DOCUMENTS 4,248,527 A * 2/1981 Akiyama et al. ..... 399/60
4,462,680 A * 7/1984 Ikeda ..... 399/58
4,999,673 A * 3/1991 Bares ..... 399/49
5,424,809 A * 6/1995 Sawayama et al.
5,436,705 A 7/1995 Raj
6,081,678 A 6/2000 Kato
6,603,934 B2 * 8/2003 Shimmura ..... 399/49
6,639,669 B2 * 10/2003 Hubble et al.
6,792,220 B2 * 9/2004 Randall et al. ..... 399/49
6,947,681 B2 9/2005 Ogata
7,097,270 B2 * 8/2006 Yamazaki
7,450,866 B2 * 11/2008 Sato ..... 399/49
2003/0137577 A1 * 7/2003 Shinohara
2005/0260004 A1 * 11/2005 Maebashi et al.
2006/0188277 A1 * 8/2006 Nishida et al. ..... 399/49
2006/0198648 A1 * 9/2006 Itagaki ..... 399/49
2007/0139733 A1 * 6/2007 Mizes et al.
2007/0196753 A1 * 8/2007 Carter et al.

FOREIGN PATENT DOCUMENTS

CN 1438550 A 8/2003
CN 1694012 A * 11/2005
CN 1694012 A 11/2005
CN 1694021 A 11/2005
EP 0903642 3/1999
EP 1 594 015 11/2005

(Continued)

*Primary Examiner*—Susan S Lee
(74) *Attorney, Agent, or Firm*—Roylance, Abrams, Berdo & Goodman, L.L.P.

(57) ABSTRACT

A toner density estimating method for a two-component developer is provided. The toner density estimating method includes: sensing photo-reflectance of a test pattern having a plurality of grayscales formed by using toner; calculating a rate of change of the photo-reflectance according to the grayscales of the test pattern; and estimating a toner density based on the rate of change. Accordingly, it is possible to accurately estimate the toner density irrespective of the influence of changes in temperature, humidity, or other external factors.

21 Claims, 12 Drawing Sheets

FOREIGN PATENT DOCUMENTS

| | | | | |
|---|---|---|---|---|
| JP | 2001086297 | A | * | 3/2001 |
| JP | 2001349778 | A | * | 12/2001 |
| JP | 2003173054 | A | * | 6/2003 |
| JP | 2006171138 | A | * | 6/2006 |
| WO | WO 03/012553 | | | 2/2003 |

* cited by examiner

FIG. 10

| IDX | ADDED TONER SUPPLY TIME | | | |
|---|---|---|---|---|
| DELTA OF DIFF | K | C | M | Y |
| −10 | −110 | −135 | −135 | −100 |
| −9 | −100 | −125 | −135 | −90 |
| −8 | −90 | −110 | −135 | −80 |
| −7 | −80 | −95 | −135 | −70 |
| −6 | −70 | −85 | −135 | −60 |
| −5 | −55 | −70 | −135 | −50 |
| −4 | −45 | −55 | −135 | −40 |
| −3 | −35 | −45 | −135 | −30 |
| −2 | −25 | −30 | −135 | −20 |
| −1 | −15 | −15 | −135 | −10 |
| 0 | 0 | 0 | −135 | 0 |
| 1 | 10 | 10 | −135 | 10 |
| 2 | 20 | 25 | −135 | 20 |
| 3 | 30 | 40 | −135 | 30 |
| 4 | 40 | 50 | −135 | 40 |
| 5 | 55 | 65 | −135 | 50 |
| 6 | 65 | 80 | −135 | 60 |
| 7 | 75 | 90 | −135 | 70 |
| 8 | 85 | 105 | −135 | 80 |
| 9 | 95 | 120 | −135 | 90 |
| 10 | 110 | 135 | −135 | 100 |

TONER DENSITY ESTIMATING METHOD AND APPARATUS USING TONER IMAGE AND TONER SUPPLYING METHOD AND APPARATUS

CROSS-REFERENCE TO RELATED PATENT APPLICATION

This application claims the benefit of Korean Patent Application No. 10-2006-0072252, filed on Jul. 31, 2006, in the Korean Intellectual Property Office, the disclosure of which is hereby incorporated by reference in its entirety.

BACKGROUND OF THE INVENTION

1. Field of the Invention

The present invention relates to an electro-photographic image forming apparatus using a two-component developer. More particularly, the invention relates to a toner density estimating method and to an apparatus for maintaining a uniform toner density in a developing unit. The invention is further directed to a toner supplying method, an apparatus using the toner density estimating method and to an apparatus to maintain a uniform toner density.

2. Description of the Related Art

In an image forming apparatus using a two-component developer, the toner density in a developing unit is maintained in the range of 6% to 10% so as to form an image having a uniform density. One method of maintaining a uniform toner density is to mount a toner density sensor in the developing unit. Since the toner density sensor is expensive, another method has been developed without using the toner density sensor. In this method, the number of dots of an output image is calculated to measure the amount of toner consumed, and toner is supplied to the developing unit according to the measured toner amount. However, since the amount of toner consumed varies with the developing voltage, temperature, humidity, and various other external factors in addition to the number of dots, errors may occur in the measurement of the amount of toner consumed.

In order to solve this problem, another method has been developed to estimate the toner density in the developing unit. A test pattern is formed on an intermediate transfer belt (ITB) to be used to measure the toner density, the photo-reflectance of the test pattern is measured and the toner density in the developing unit is estimated using the measured reflectance of the test pattern. The test pattern is a toner image having a predetermined length and width formed to allow the toner density to be estimated. This method does not need a toner density sensor, and can control the toner density relatively accurately according to the density of the test pattern. However, when the density of the test pattern varies due to changes in temperature, humidity, charging voltage, or other external factors in addition to the variation of the toner density in the developing unit, the cause is difficult to identity. Therefore, the toner density in the developing unit may be measured as being outside its setting range, even when it is not. In this case, toner for maintaining the density of the test pattern is erroneously supplied, causing toner to be over-supplied or under-supplied. This can cause additional problems such as scatter of toner, leakage of the developer, and increase in the driving torque of the developer.

SUMMARY OF THE INVENTION

The present invention provides a toner density estimating method and apparatus in which photo-reflectance of a test pattern having a plurality of grayscales formed with toner are measured to measure a toner density. In this manner, it is possible to accurately estimate the toner density in a developing unit irrespective of changes in temperature, humidity, or other external factors.

The present invention also provides a toner supplying method and apparatus, in which, although photo-reflectance of a test pattern vary with changes in external factors, a toner density is accurately estimated to monitor an abnormal state of the toner density. In the abnormal state, the toner is supplied so as not to be over-supplied or under-supplied, so that the toner density can be maintained in a uniform level According to an aspect of the present invention, a toner density estimating method is provided comprising: (a) sensing photo-reflectance of a test pattern having a plurality of grayscales formed by using toner; (b) calculating a rate of change of the photo-reflectance according to the grayscales of the test pattern; and (c) estimating a toner density based on the rate of change.

In the above aspect of the invention, the toner density estimating method may further comprise forming the test pattern having a plurality of grayscales by using the toner.

In addition, step (b) may comprise: generating a linear equation based on the change of the photo-reflectance according to the grayscales of the test pattern; and calculating the rate of change by using a slope of the linear equation.

In step (c), the toner density corresponding to the rate of change may be estimated by using information on a toner density corresponding to predetermined photo-reflectance.

According to another aspect of the present invention, a toner supplying method is provided comprising: (a) estimating a toner density by using consumed and supplied toner amounts; (b) sensing photo-reflectance of a test pattern having a plurality of grayscales formed by using the toner according to whether or not the toner density estimated in (a) is in a setting range; (c) estimating the toner density based on a rate of change of the photo-reflectance according to the grayscales of the test pattern; and (d) supplying the toner according to the toner density estimated in (c).

In the above aspect of the invention, the toner supplying method may further comprise: (e) when the toner density estimated in (a) is in the setting range, sensing photo-reflectance of a test pattern having predetermined grayscales formed by using the toner; and controlling toner supply according to a result of comparison of the photo-reflectance sensed in (e) with a reference value, wherein the reference value is photo-reflectance of the test pattern having the predetermined grayscales corresponding to a reference density.

According to another aspect of the present invention, a toner density estimating apparatus is provided comprising: a sensor which senses photo-reflectance of a test pattern having a plurality of grayscales formed by using toner; and a density estimating unit which estimates a toner density based on a rate of change of the photo-reflectance according to the grayscales of the test pattern.

In the above aspect of the invention, the toner density estimating apparatus may further comprise a test pattern forming unit which forms the test pattern having a plurality of grayscales by using the toner.

The toner density estimating apparatus may further comprise a test pattern forming unit which forms the test pattern having a plurality of grayscales by using the toner, wherein the density estimating unit estimates the toner density corresponding to the rate of change by using information on the toner density corresponding to the rate of change of the photo-reflectance.

According to another aspect of the present invention, a toner supplying apparatus is provided, comprising: a measuring unit which measures consumed and supplied toner amounts; a first density estimating unit which estimates a toner density by using a result of measurement of the measuring unit; a test pattern forming unit which forms a test pattern having a plurality of grayscales by using the toner; a sensor which senses photo-reflectance of the test pattern having a plurality of grayscales; a second density estimating unit which estimates the toner density based on a rate of change of the photo-reflectance according to the grayscales of the test pattern; and a controller which controls toner supply according to the densities of toner estimated by the first and second estimating units.

In the above aspect of the invention, the test pattern forming unit may form a test pattern having predetermined grayscales by using the toner, wherein the sensor senses photo-reflectance of the formed test pattern having the predetermined grayscales, and the controller may control the toner supply according to a result of comparison of the photo-reflectance of the test pattern having the predetermined grayscales with photo-reflectance of the test pattern having the predetermined grayscales corresponding to a reference density.

BRIEF DESCRIPTION OF THE DRAWINGS

The above and other features and advantages of the present invention will become more apparent by describing in detail exemplary embodiments thereof with reference to the attached drawings in which:

FIG. 10 is a table of to-be-corrected supplied toner amounts corresponding to the difference between a reference value and photo-reflectance of a test pattern corresponding to predetermined grayscales according to an embodiment of the present invention;

DETAILED DESCRIPTION OF THE INVENTION

A toner density estimating method and apparatus and a toner supplying method and apparatus according to exemplary embodiments of the present invention will now be described with reference to the accompanying drawings.

Figure 1:
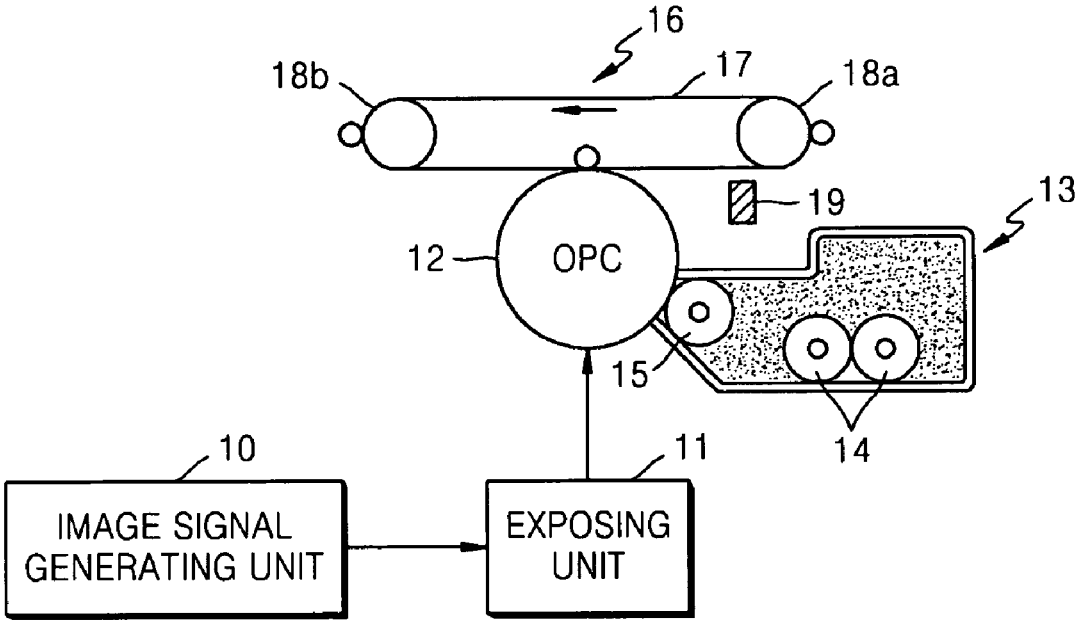
FIG. 1 is a schematic view of an electro-photographic image forming apparatus according to an embodiment of the present invention.

A system of an image forming apparatus according to an embodiment of the present invention is described with reference to FIG. 1. FIG. 1 is a schematic view of an electro-photographic image forming apparatus using a two-component developer according to the embodiment of the present invention. An image signal generating unit 10 generates an image signal corresponding to image data and applies the image signal to an exposing unit 11. The exposing unit 11 scans light onto a photosensitive medium 12 according to the image signal, to form an electrostatic latent image. A developing unit 13 is supplied with toner from a toner cartridge (not shown) and uses a stirring roller 14 and a carrying roller 15 to supply the toner to the electrostatic latent image formed on the photosensitive medium 12, to generate a developed latent image. A transfer unit 16 transfers the developed latent image onto an intermediate transfer belt (ITB) 17. The developed latent image is transferred from the ITB 17 to a printed medium to form a printed image. The printed image is fixed on a fixing unit 18 and discharged from the image forming apparatus.

A CTD sensor 19 senses the photo-reflectance of a test pattern formed on the ITB 17. The test pattern is a toner image patch formed that is used to estimate the toner density. The photo-reflectance includes the normal reflection and scattered reflection of a light scanned from the test pattern. The CTD sensor is a photo-electric device which receives the reflected light from the test pattern and transforms it into electrical energy.

The output of the photo-electric device which senses the normal reflectance of the scanned light is inversely proportional to the grayscale value of the test pattern and the toner density. The output of the photo-electric device which senses the scattered reflectance of the scanned light is proportional to the grayscale value of the test pattern and the toner density.

The grayscale of the test pattern is a grayscale of the toner which is transferred to the test pattern. The grayscale of the test pattern is represented by a ratio of pixels corresponding to the transferred toner with respect to the entire pixels corresponding to the entire area of the test pattern. When the toner is transferred to all the pixels, the grayscale value is "full solid", that is, 100% grayscale. When the toner is transferred to 75% or 50% of the pixels, the grayscale value is 75% or 50% grayscale, respectively. In order to accurately sense the reflectance with respect to the grayscale value of the test pattern, the toner needs to be transferred so as to allow the pixels transferred with the toner among the pixels corresponding to the test pattern to be distributed uniformly, when the test pattern is formed A toner density estimating method and apparatus according to an embodiment of the present invention will now be described.

Figure 2:
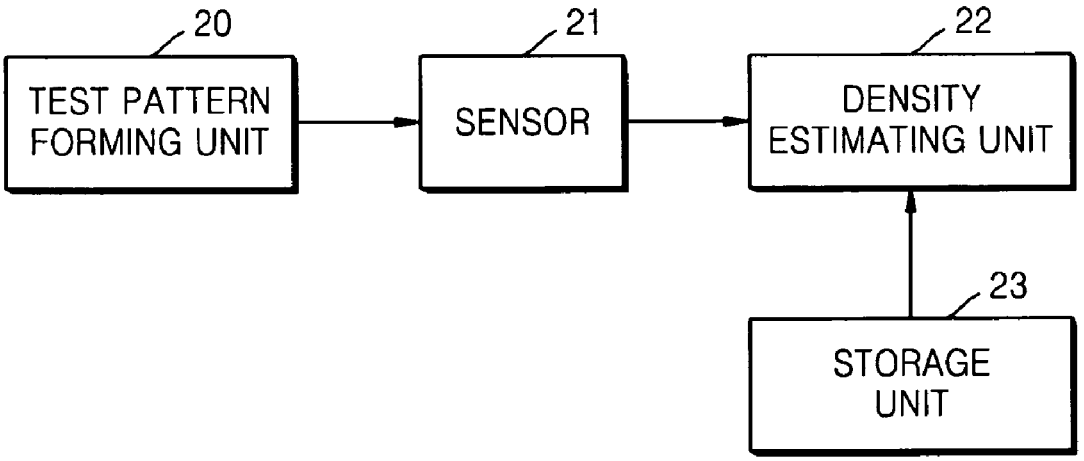
FIG. 2 is a block diagram of a toner density estimating apparatus according to an embodiment of the present invention.

FIG. 2 shows the toner density estimating apparatus using the test pattern having a plurality of grayscales according to the embodiment of the present invention. The toner density estimating apparatus includes a test pattern forming unit 20, a sensor 21, a density estimating unit 22, and a storage unit 23.

Figure 3:
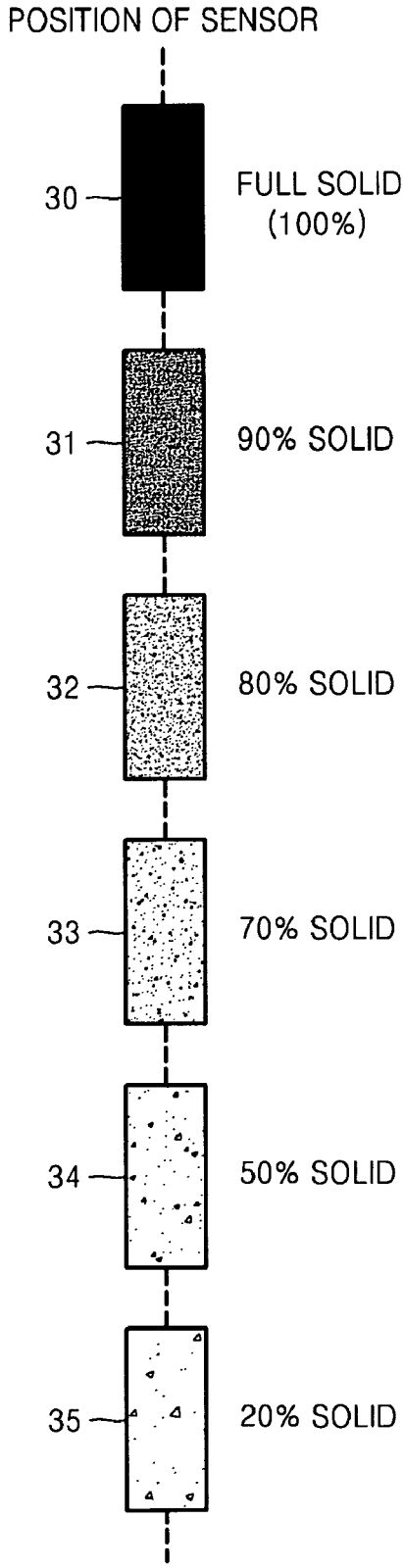
FIG. 3 shows a test pattern having a plurality of grayscales according to an embodiment of the present invention.

The test pattern forming unit 20 forms the test pattern having a plurality of grayscales using the toner. In a color image forming apparatus, a test pattern may be generated using one color of toner, or test patterns may be generated sequentially using the respective colors of toner. As described above, the grayscale value of the test pattern is the density of brightness of the test pattern, and varies with the ratio of the transferred amount of toner to the entire amount of toner. For example, a test pattern may be formed of six grayscale values of 100%, 90%, 80%, 70%, 50% and 20%. This is an example for convenience of description, but other test patterns of various grayscales may be formed. The test pattern is typically formed of a plurality of graduated grayscale patterns that can sequentially increase or decrease in intensity. FIG. 3 shows the test pattern having a plurality of grayscales formed using the toner according to the embodiment of the present invention. As shown in FIG. 3, the test pattern of 100% grayscale 30, 90% grayscale 31, 80% grayscale 32, 70% grayscale 33, 50% grayscale 34, and 20% grayscale 35 is formed to a uniform size and pitch.

Figure 4A:
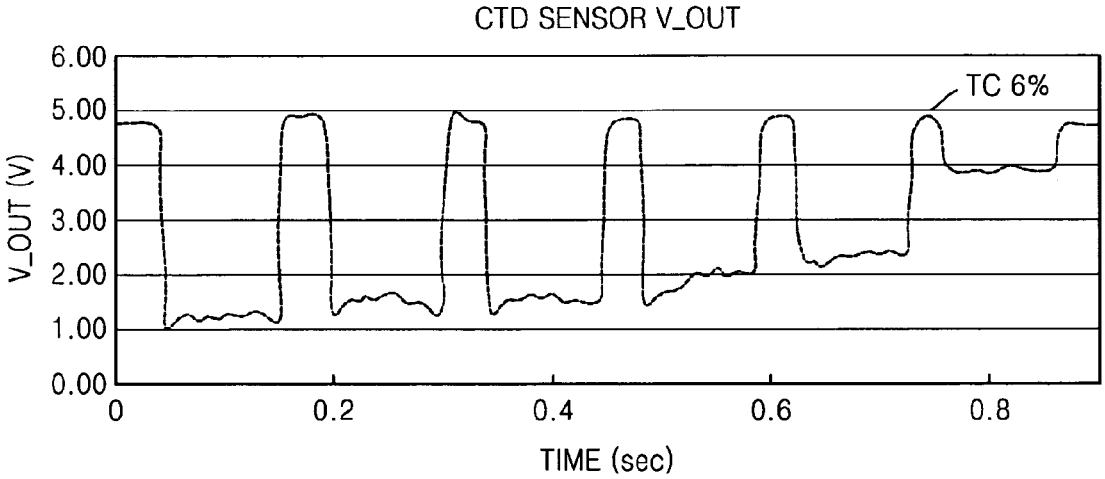
FIGS. 4A to 4C are graphs of the photo-reflectance of the test pattern having a plurality of grayscales shown in FIG. 3 measured by a CTD sensor.
Figure 4B:
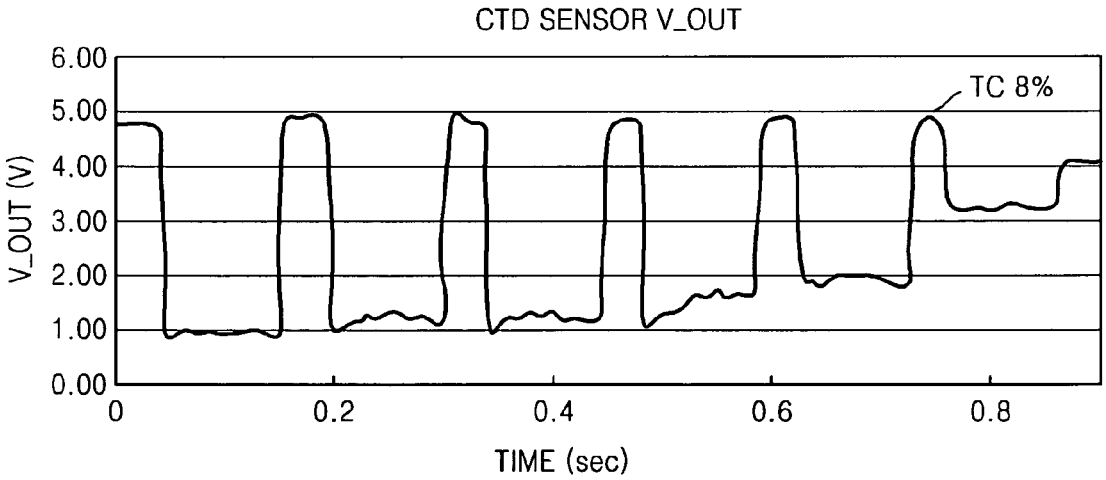
Figure 4C:
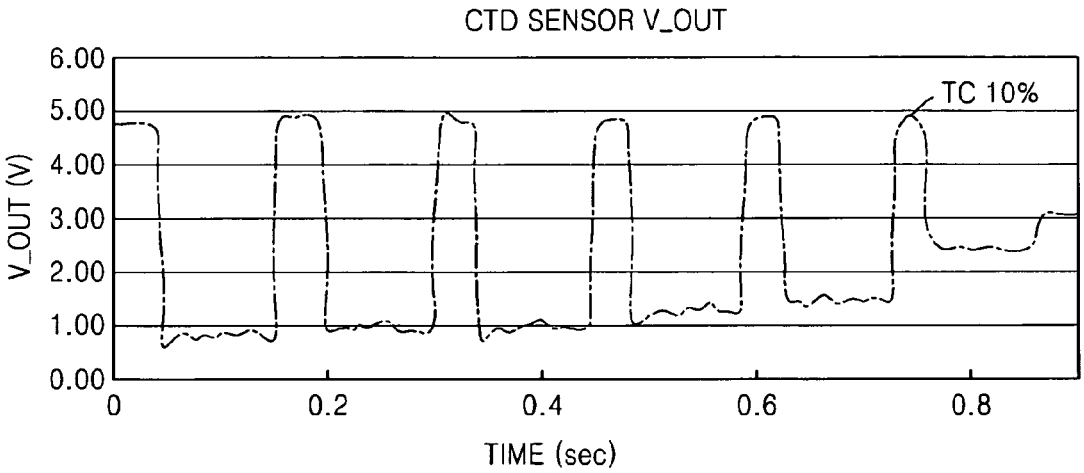

The sensor 21 senses the photo-reflectance of the test pattern having a plurality of grayscales. The sensor 21 may include a CTD sensor or another photo-electric device which transforms light into electrical energy. The CTD sensor scans the test pattern formed on the ITD 17 with light and receives reflected light. The CTD sensor transforms the received light into electrical energy and outputs a voltage or current according to the transformed energy. Therefore, the output, for example, the output voltage of the CTD sensor, varies with the intensity of the reflected light. FIGS. 4A to 4C are graphs of photo-reflectance of the test pattern having a plurality of grayscales shown in FIG. 3 measured by the CTD sensor.

The test pattern used for FIGS. 4A to 4C has grayscales with respect to 6%, 8%, and 10% toner densities. In the sensing results of the CTD sensor, the test patterns are sorted by grayscale in descending order. It can be seen that the output voltage of the CTD sensor increases with time. In addition, it can be seen that although the rate of change varies with the toner density, the output voltage of the CTD sensor is inversely proportional to the grayscale value of the test pattern. This is the result of measuring the normal reflectance of the test pattern. As more toner is transferred to the test pattern, the normal reflectance of the scanned light decreases, and as less toner is transferred to the test pattern, the normal reflectance of the scanned light increases. Therefore, when the grayscale value of the test pattern decreases, the amount of transferred toner decreases, so that the intensity of the reflected light increases, and the output voltage of the CTD sensor increases.

Figure 5:
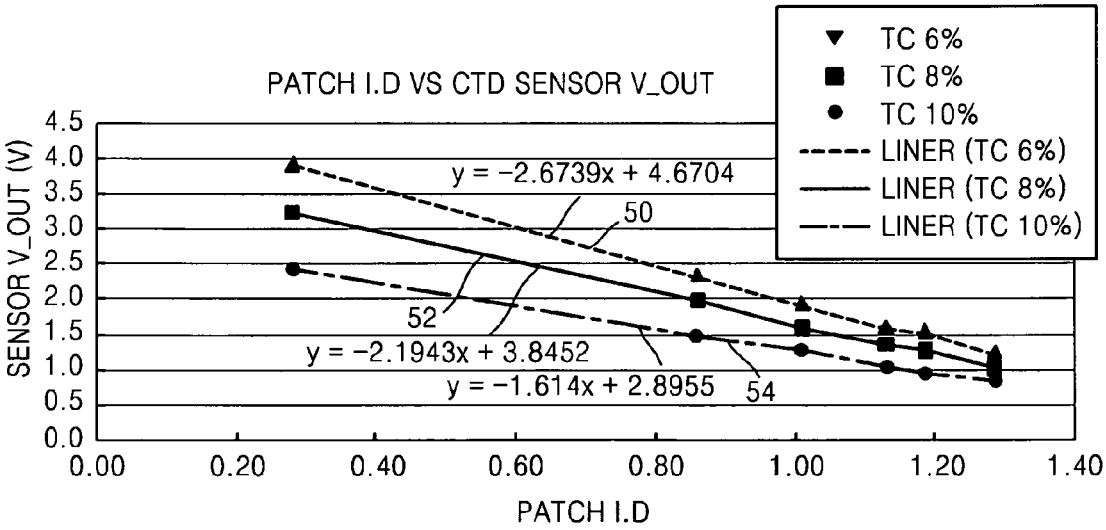
FIG. 5 is a graph showing the change in average output voltage of the CTD sensor according to the grayscales of the test pattern shown in FIGS. 4A to 4C in terms of toner density.

In addition, the rate of increase of the output voltage of the CTD sensor with respect to the grayscale value of the test pattern varies with the toner density. It can be seen that when the toner density is high, the rate of increase of the output voltage of the CTD sensor with respect to the grayscale value of the test pattern decreases. FIG. 5 is a graph showing the change in average output voltage of the CTD sensors according to the grayscales of the test pattern in terms of toner density. The values indicated by triangles are the average output voltage of the CTD sensor according to the grayscales of the test pattern in the case of a 6% toner density. The values indicated by rectangles and circles are the average output voltage of the CTD sensor according to the grayscales of the test pattern in the cases of 8% and 10% toner density, respectively.

The density estimating unit 22 calculates the rate of change of the photo-reflectance according to the grayscales of the test pattern sensed by the sensor 21, and estimates the toner density by using the calculated rate of change. The change in the photo-reflectance of the test pattern according to the grayscale value of the test pattern may be represented by an approximately linear equation. As shown in FIG. 5, according to the embodiment of the present invention, a linear equation of the change of the average value of the output voltage of the CTD sensor according to the grayscale value of the test pattern may be obtained.

According to the embodiment of the present invention, in the case of 6% toner density, the rate of change in the average output voltage of the CTD sensor with respect to the grayscale value of the test pattern, that is, the slope of graph is −2.6739, in the case of 8% toner density, the rate is −2.1943, and in the case of a 10% toner density, the rate is −1.614. Since the rate of change of the photo-reflectance with respect to the grayscale value of the test pattern, that is, the slope of the approximate linear equation of the average output voltage of the CTD sensor with respect to the grayscale value of the test pattern varies with the toner density, it can be understood that the slope has a correlation with the toner density. Therefore, by taking into consideration the correlation between the slope and the toner density, the toner density can be estimated from the rate of change in the photo-reflectance with respect to the grayscale value of the pattern.

In an exemplary embodiment, information on the densities of toner corresponding to the rates of change of the photo-reflectance with respect to the grayscales of the test pattern may be set in advance, and the toner density may be estimated from the rates of change of the photo-reflectance with respect to the grayscales of the test pattern calculated by using the information on the densities of toner corresponding to the rates of change of the photo-reflectance with respect to the grayscales of the test patterns. The information on the densities of toner corresponding to the rates of change of the photo-reflectance with respect to the grayscales of the test pattern may be stored in a memory in the form of a lookup table.

The storage unit 23 stores information on the estimated toner density. Accordingly, when the developing unit 13 is mounted for the first time or replaced in the image forming apparatus, or after the developing unit 13 is stopped and then operates again, the current toner density can be set by using the information on the toner density stored in the storage unit 23. Therefore, preferably, the storage unit 23 is constructed together with the developing unit 13.

In addition, the storage unit may store the information on the densities of toner corresponding to the rates of change of the photo-reflectance with respect to the grayscales of the test patterns. In addition, the storage unit 23 may correct the information on the densities of toner corresponding to the rates of change of the photo-reflectance with respect to the grayscales of the test pattern by using the stored densities of the test pattern and the calculated rates of change of the photo-reflectance with respect to the grayscales of the test patterns. More particularly, when the developing unit 13 is mounted on the image forming apparatus, the test pattern having a plurality of grayscales is generated, the photo-reflectance of the test pattern having a plurality of grayscales are sensed, and the rates of change of the photo-reflectance corresponding to the grayscales of the test pattern are calculated. The current toner density is estimated from the rates of change of the photo-reflectance by using the information on the densities of toner corresponding to the rates of change of the photo-reflectance with respect to the grayscales of the test patterns. When the difference between the estimated toner density and the toner density stored in the storage unit 23 is not within an allowable error range, the information on the densities of toner corresponding to the rates of change of the photo-reflectance with respect to the grayscales of the test pattern is corrected so as to allow the toner density equal to the stored toner density to be estimated from the calculated rate of change of the photo-reflectance.

When the developing unit 13 is mounted for the first time on an image forming apparatus, or when the developing unit 13 is replaced and mounted for the first time on another image forming apparatus, particularly, in the case of an unused developer, since the toner density in the developer is maintained at a reference density at the time of production, the information on the toner density stored in the storage unit 23 is accurate. Therefore, the information on the toner density corresponding to the rate of change of the photo-reflectance with respect to the grayscale value of an image can be corrected so that the toner density stored in the storage unit 23 to be estimated from the calculated rate of change of the photo-reflectance. As a result, when the toner density is continuously estimated, it is possible to obtain a reliable estimated toner density.

Figure 6:
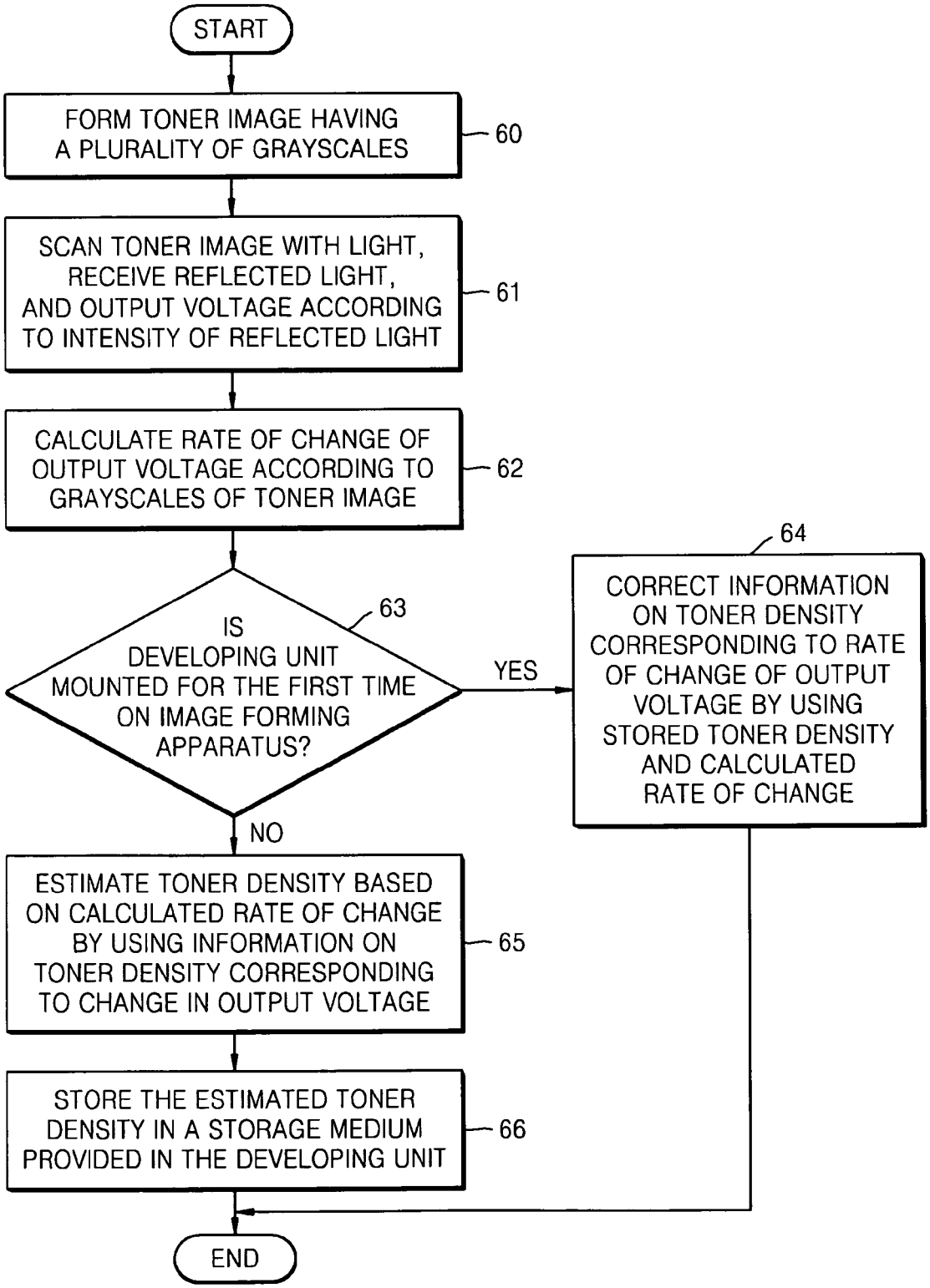
FIG. 6 is a flowchart of a toner density estimating method according to an embodiment of the present invention.

A toner density estimating method according to an embodiment of the present invention will now be described. FIG. 6 is flowchart of the toner density estimating method using the test pattern corresponding to the grayscales according to the embodiment of the present invention.

In operation 60, a toner density estimating apparatus forms the test pattern having a plurality of grayscales by using toner. The grayscales of the test pattern and the number of grayscales may be determined in various manners.

In operation 61, the toner density estimating apparatus scans the test pattern corresponding to the grayscale with light, receives reflected light of the scanned light, and outputs a voltage according to the intensity of the reflected light.

In operation 62, the toner density estimating apparatus generates a linear equation representing the change in output voltage with respect to the grayscale value of the test pattern and calculates a rate of change of the output voltage with respect to the grayscale value of the test pattern by calculating the slope of the linear equation.

In operation 63, the toner density estimating apparatus determines whether a developing unit is mounted in an image forming apparatus for the first time. When the developing unit is determined to be mounted for the first time, in operation 64, information on the toner density corresponding to the rate of change of the output voltage with respect to the predetermined grayscale value of the test pattern is corrected by using the stored toner density and the calculated slope of the linear equation.

When the developing unit is not determined to be mounted for the first time, in operation 65, the toner density is estimated from the calculated rate of change by using the information on the toner density corresponding to the rate of change of the output voltage with respect to the predetermined grayscale value of the test pattern.

In operation 66, the toner density estimating apparatus stores a value of the estimated toner density in a storage medium provided in the developing unit which supplies the toner. In one embodiment, a computer-readable recording medium having embodied thereon a program for a toner density estimating method for estimating toner density of toner on a developing unit of an image forming apparatus comprises: (a) sensing photo-reflectance of a test pattern having a plurality of grayscales formed from toner on a surface of the developing unit; (b) calculating a rate of change of the photo-reflectance according to the plurality of grayscales of the test pattern; and (c) estimating a toner density based on the rate of change.

In the toner density estimating method and apparatus according to the embodiments of the present invention, the toner density is estimated from the rates of change of the photo-reflectance with respect to the grayscales of the test pattern by taking into consideration that although the measured output voltage of the CTD sensor corresponding to the photo-reflectance of the test pattern may vary, the range of change of the output voltage of the CTD sensor for each of the test patterns is substantially uniform. Therefore, in the embodiment of the present invention, the toner density is not directly estimated from the photo-reflectance of the test patterns, but is estimated relatively from the rate of change of the photo-reflectance with respect to the grayscales of the test patterns. As a result, it is possible to accurately measure the toner density in the developing unit irrespective of the influence of changes in temperature, humidity, or other external factors.

A toner supplying apparatus and method according to an embodiment of the present invention will now be described.

Figure 7:
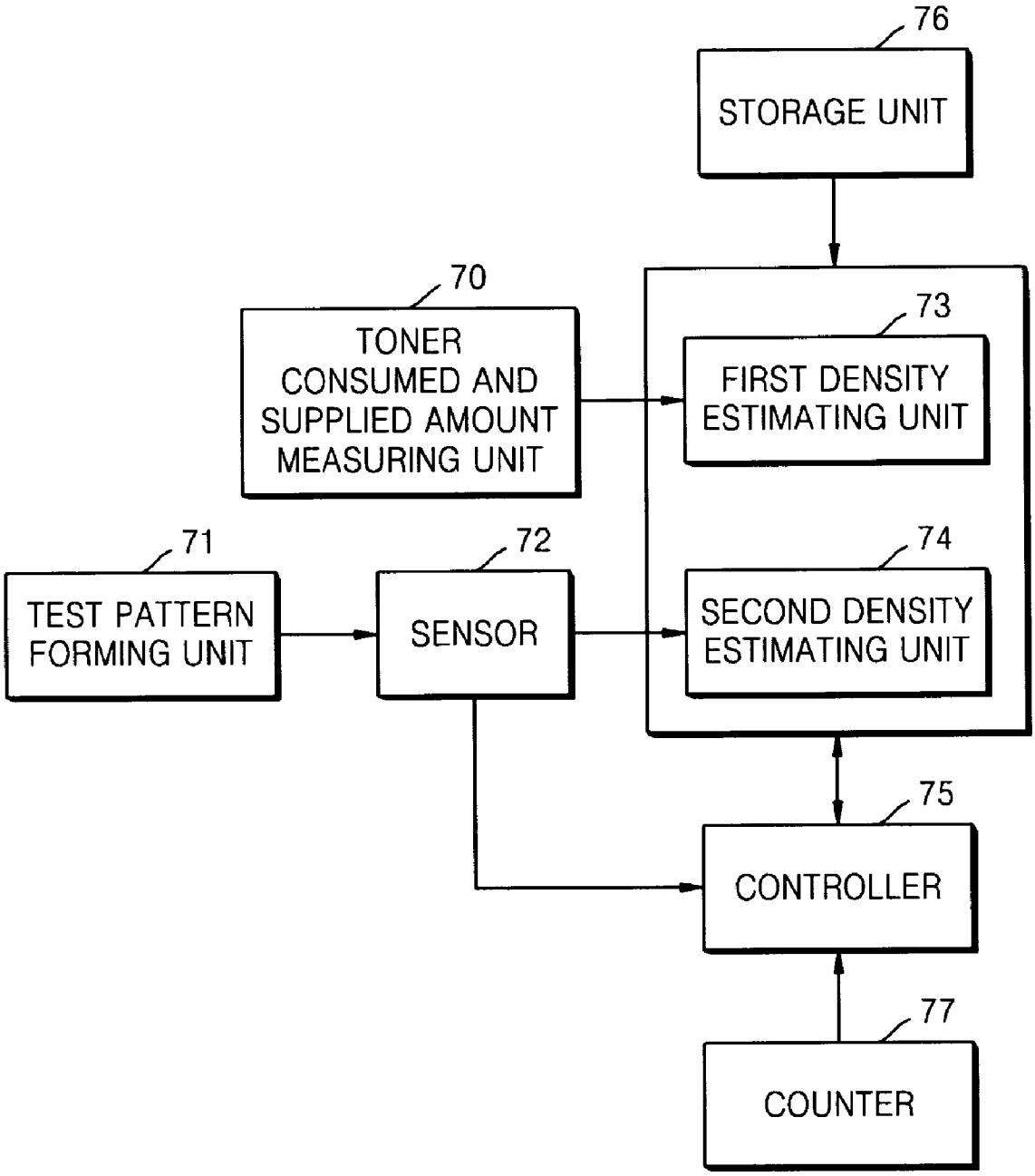
FIG. 7 is a block diagram of a toner supplying apparatus according to an embodiment of the present invention.

FIG. 7 is a block diagram showing the toner supplying apparatus according to the embodiment of the present invention. The toner supplying apparatus includes a measuring unit 70, a test pattern forming unit 71, a sensor 72, a first density estimating unit 73, a second density estimating unit 74, a controller 75, a storage unit 76, and a counter 77.

The measuring unit 70 measures the amount of toner consumed and the amount of toner supplied. According to the embodiment of the present invention, the measuring unit 70 calculates the number of dots of an output image and calculates the coverage of the image based on the number of dots to measure the amount of toner consumed for the output image. The coverage of an image is the ratio of the number of dots of an output image to the number of dots of the entire printing paper. Preferably, the measuring unit 70 stores the number of dots of the entire printing paper and the amount of toner consumed according to the coverage of the output image according to the colors of toner in advance.

Figure 8A:
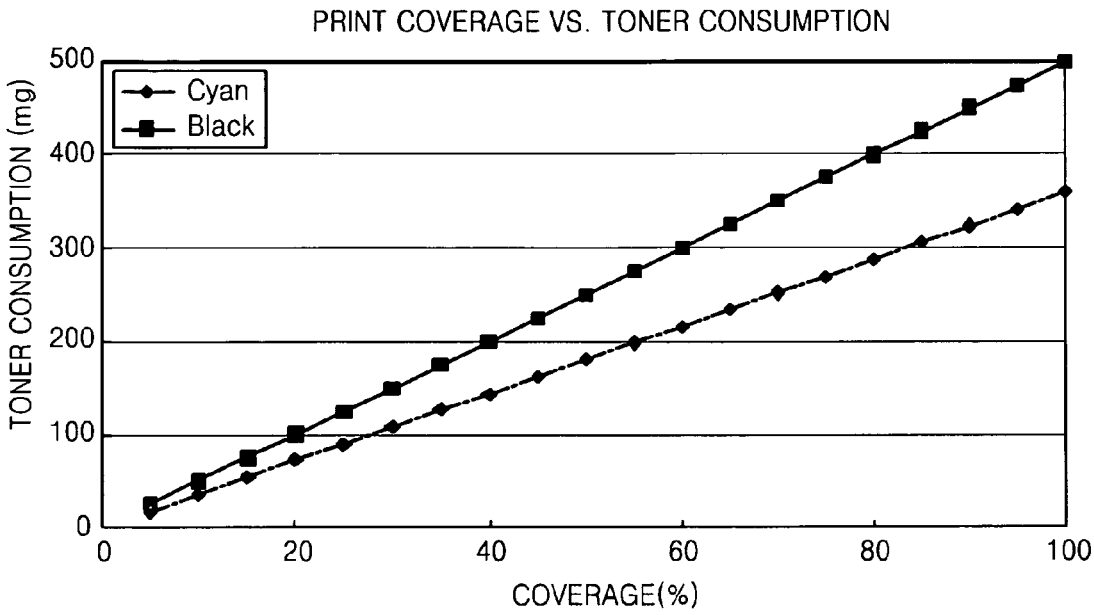
FIG. 8A is a graph showing consumed toner amount according to coverage of an output image according to an embodiment of the present invention.

FIG. 8A is a graph showing the consumed toner amount according to coverage of the output image according to the embodiment of the present invention. As shown in FIG. 8A, the consumed toner amounts according to the coverage of the output image increase linearly, and the rates of increase of the toner consumed amounts according to the coverage of the output image corresponding to the colors of toner are different from each other. When a color image is output, the measuring unit 70 calculates the number of dots corresponding to the colors of the output image and the coverage of the image based on the number of dots to measure the consumed toner amounts corresponding to the colors according to the calculated coverage.

Figure 8B:
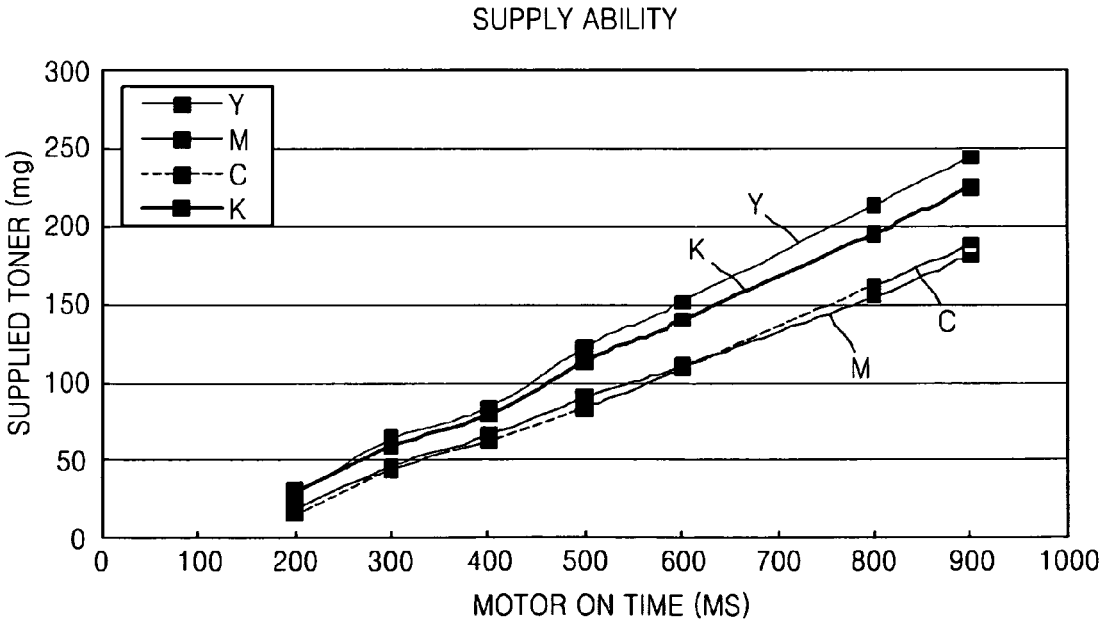
FIG. 8B is a graph showing supplied toner amount according to operating time of a toner supply motor according to an embodiment of the present invention.

In addition, the measuring unit 70 may calculate the supplied toner amount according to the operating time of a toner supply motor. FIG. 8B is a graph showing the supplied toner amount according to the operating time of the toner supply motor according to the embodiment of the present invention. Preferably, the measuring unit 70 stores the supplied toner amounts according to the operating time of the toner supply motor in advance.

The first density estimating unit 73 estimates the toner density by using the measured amounts of the consumed and supplied toner, which are measured by the measuring unit 70. With respect to a two-component developer, the amount of carrier in a developing unit is constant. Therefore, by using the consumed and supplied toner amounts, it is possible to estimate the toner density in the developing unit.

The consumed toner amount according to the coverage of the output image and the supplied toner amount according to the operating time of the toner supply motor may vary with the temperature, humidity, or other external factors. In this case, if the toner is supplied based on the toner density estimated according to the aforementioned method, the measurement errors of the consumed and supplied toner amounts accumulate as the number of output paper sheets of an image forming apparatus increases, so that the toner density may not be in a setting range. Therefore, after a predetermined number of paper sheets are discharged, the measurement error needs to be adjusted or compensated by using an actual test pattern.

The test pattern forming unit 71 together with the sensor 72 and the second density estimating unit 74 generates the test pattern having grayscales, and estimates the toner density using the test pattern to compensate for the measurement error based on the result of the estimation. When the toner density estimated by the first density estimating unit 22 is outside a predetermined setting range in an abnormal state, the test pattern having a plurality of grayscales can accurately estimate the toner density. Therefore, although the toner density is in an abnormal state, the toner may not be over-supplied or under-supplied but is maintained at a uniform level.

Figure 9:
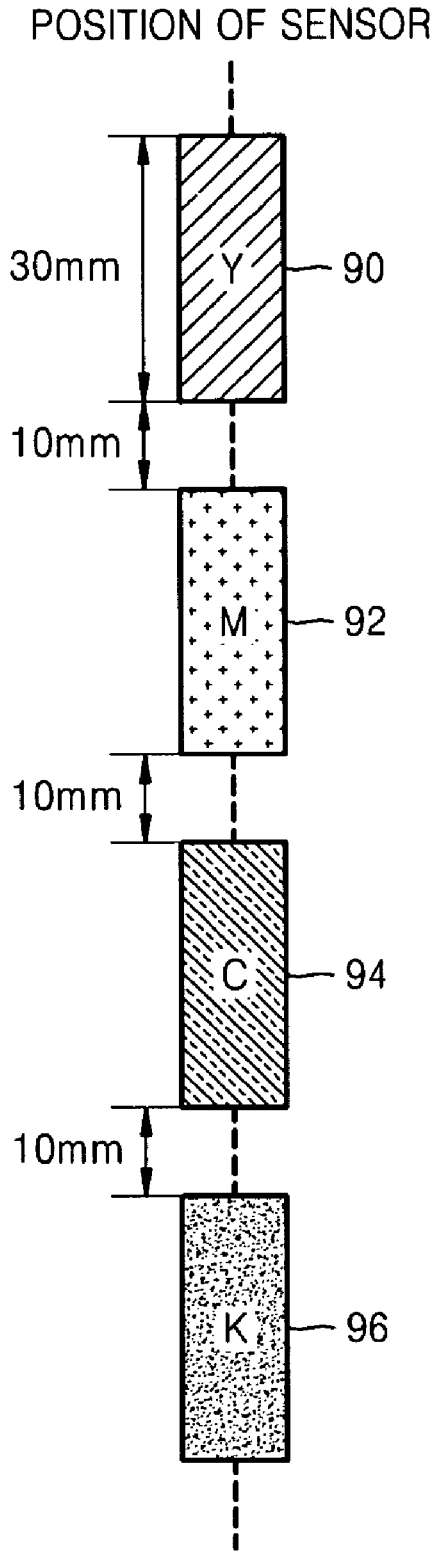
FIG. 9 shows a test pattern corresponding to predetermined grayscales formed with color toners according to an embodiment of the present invention.

The test pattern forming unit 71 forms a test pattern having predetermined grayscales and a test pattern having a plurality of grayscales using the toner. Preferably, the grayscales of the test pattern are set in advance. FIG. 9 shows a test pattern sequentially having predetermined grayscales for yellow 90, magenta 92, cyan 94, and black 96. In the color image forming apparatus according to an embodiment of the present invention, when the test pattern forming unit 71 forms the test pattern corresponding to a predetermined grayscale, the test pattern corresponding to the predetermined grayscale according to the full color is formed at one time. However, other modifications may be available, and the grayscale value of the test pattern may also be set in the range of 0% to 100%.

When the toner density estimated by the first density estimating unit 73 is not in the setting range, the test pattern forming unit 72 forms the test pattern having a plurality of grayscales. The test pattern having a plurality of grayscales formed according to the embodiment of the present invention is shown in FIG. 3. The test pattern having a plurality of grayscales is the same as that of the aforementioned toner density estimating apparatus, and thus, a detailed description is omitted.

The sensor 72 senses the photo-reflectance of the test pattern having a plurality of grayscales. The photo-reflectance of the test pattern can be sensed by a photo-electric drive, such as a CTD sensor. The sensor 21 also senses the photo-reflectance of the test pattern corresponding to the predetermined grayscales. In a case where the test pattern corresponding to the predetermined grayscale according to the colors is sensed, voltages corresponding to the photo-reflectance according to the colors are produced. On the other hand, in a case where the test pattern corresponding to the grayscale for one color is sensed, voltages corresponding to the photo-reflectance according to the grayscales of the test pattern are produced.

The second density estimating unit 74 estimates the toner density by using the produced output voltages from the CTD sensor which senses the test pattern according to the grayscales. The toner estimating method performed by the second density estimating unit 22 is similar to the aforementioned method performed by the density estimating unit 22 of the toner density estimating apparatus, and thus, a detailed description is omitted.

The controller 75 controls the toner supply according to the toner density estimated by the first and second density estimating units 73 and 74. When the toner density estimated by the first density estimating unit is in a setting range, the controller 75 controls the toner supply according to the toner density estimated by the first density estimating unit 73. When the toner density estimated by the first density estimating unit is not within the setting range, the controller 75 controls the toner supply according to the toner density estimated by the second density estimating unit 74.

According to the embodiment of the present invention, the toner supplying method using the toner density estimated by the first density estimating unit 73 is performed by the controller 75 as follows. When the toner density estimated by the first density estimating unit 73 is within the setting range, the controller 75 controls the toner supply to allow an amount of toner equal to the consumed toner amount measured by the measuring unit 70 to be supplied to the developing unit, so that the toner density in the developing unit is maintained at a uniform level. More specifically, the controller 75 controls the toner supply according to the operating time of the toner supply motor measured by the measuring unit 70 to allow an amount of toner equal to the consumed toner amount to be supplied to the developing unit.

According to the embodiment of the present invention, when the toner density estimated by the first density estimating unit 73 is not in the setting range but is in an abnormal state, the controller 75 controls the toner supply according to the toner density estimated by the second density estimating unit 74 as follows.

When the toner density estimated by the first density estimating unit 73 is not in the setting range, the second density estimating unit 74 estimates the toner density again. As a result of the toner density estimating by the second density estimating unit 74, when the toner density is determined to be within the setting range, the change in the density in the output image is caused by a change in the temperature, humidity, charging voltage, bias voltage, or other external factors, but the actual toner density in the developing unit 13 is unchanged. In this case, as a result of the toner density estimating by the second density estimating unit 74, the toner density in the developing unit is estimated to be within the setting range. Therefore, an amount of toner equal to the consumed toner amount measured by the measuring unit 70 can be supplied. In other words, the toner supply for the abnormal state can be controlled by using the same method as for the normal state.

However, when the toner density estimated by the second density estimating unit 74 is not in the setting range, the change in the actual toner density in the developing unit 13 is caused by external factors. Therefore, in this case, the toner supply needs to be controlled to maintain the toner density in the developing unit in the setting range. When the toner density estimated by the second density estimating unit 74 is over or outside the setting range, the toner supply is controlled to stop until the toner density is within the setting range. When the toner density estimated by the second density estimating unit 74 is under or below the setting range, the toner supply is performed until the toner density is within the setting range. In addition, the image is not output until the toner density is in the setting range, and the image is output only if the toner density is in the setting range, so that it is possible to form an image of uniform density.

In the toner supplying apparatus and method according to the embodiment of the present invention, a toner density sensor is not used, but the consumed and supplied toner amounts are used to estimate the toner density. When the estimated toner density is in an abnormal state, the test pattern according to the grayscales is generated, and the toner density can be accurately estimated by the test pattern without interference of external factors. Therefore, even in the abnormal state, the toner can be accurately supplied, so that the toner density is maintained at a uniform level without departing from the setting range. Accordingly, it is possible to avoid problems such as scattering of toner, leakage of a developer, and increase in torque for driving developer in a developing unit.

However, even when the toner density estimated by the first density estimating unit 73 is determined to be within the setting range, errors may occur in measuring the consumed and supplied toner amounts. In the toner supplying apparatus according to the embodiment of the present invention, after a predetermined number of paper sheets are output, the test pattern corresponding to the predetermined grayscales is generated to compensate for measurement errors of the measuring unit 70.

A method of compensating the measurement errors of the measuring unit 70, performed by the controller 75 using the test pattern corresponding to the predetermined grayscales, will now be described.

The controller 75 controls the toner supply based on the result of comparing the photo-reflectance of the test pattern corresponding to the predetermined grayscales (hereinafter, referred to as a test pattern for correction) with a reference value. The reference value is the photo-reflectance of the test pattern for correction according to a predetermined reference toner density. According to the embodiment of the present invention, the controller 75 calculates the difference between the sensed photo-reflectance and the reference value. The controller 75 controls the toner supply according to the calculated difference by using information on the supplied toner amount corresponding to the difference.

For example, when the photo-reflectance of the test pattern for correction are sensed with the CTD sensor, since the grayscales of the test pattern for correction are uniform, the photo-reflectance of the test pattern for correction vary with the density of the toner used for forming the test pattern for correction. More specifically, when the normal photo-reflectance of the test pattern for correction are sensed, the output voltage of the CTD sensor is inversely proportional to the toner density. When abnormal photo-reflectance of the test pattern for correction are sensed, the output voltage of the CTD sensor is proportional to the toner density.

As an example of the embodiment of the present invention, a case where the normal photo-reflectance of the test pattern for correction are sensed with the CTD sensor is described. When the normal photo-reflectance of the test pattern for correction are sensed, the intensity of the normally reflected light decreases as the amount of toner attached to the test pattern increases, so that the output voltage is lower. For example, in a case where the reference toner density is 9% and the output voltage of the CTD sensor for the test pattern having the grayscale 70% formed from the toner corresponding to the reference density is 1 V, when the output voltage of the CTD sensor for the test pattern having the grayscale 70% is higher than 1 V, the toner density used for generating the test pattern is lower than the reference density 9%. When the output voltage of the CTD sensor for the test pattern having the grayscale 70% is lower than 1 V, the toner density used for generating the test pattern is higher than the reference density 9%. When the result of sensing the test pattern for correction is different from the reference value, that is, the result of sensing the reference density, there is a difference between the reference density and the toner density in the developing unit. Therefore, the controller 75 controls the toner supply in order to compensate for the measurement error. Thus, the controller 74 can maintain the toner density in the developing unit at the reference density.

According to the embodiment of the present invention, the controller 75 controls the correspondence between the output voltage of the CTD sensor and the supplied toner amount according to the difference from the reference value which is stored in advance. Next, the controller 75 calculates the difference between the reference value, that is, the output voltage of the CTD sensor corresponding to the reference density, and the output voltage of the CTD sensor for the test pattern for correction, sensed by the sensor 72, and controls the supply of toner to the developing unit according to the supplied toner amount corresponding to the calculated difference. FIG. 10 is a table of supplied toner amounts controlled according to the photo-reflectance of the test pattern for correction and the reference value according to the embodiment of the present invention. The left column, labeled "index IDX", lists the differences between the photo-reflectance of the test pattern for correction and the reference value. The right column, labeled "added toner supply time", lists the operating time of the toner supply motor, that is, the toner supply time, which varies with the difference between the photo-reflectance of the test pattern for correction and the reference value according to the colors.

When the value of the index IDX is positive, the output voltage of the CTD sensor for the test pattern for correction is higher than the reference value, so that the toner density is lower than the reference density. Therefore, the operating time of the toner supply motor is increased, so that the toner density increases up to the reference density. On the other hand, when the value of the index IDX is negative, the toner density is higher than the reference density. Therefore, the operating time of the toner supply motor is decreased, so that the toner density decreases down to the reference density. The correspondence is stored as a table in a memory or the like. By using the stored correspondence, the operating time of the toner supply motor is controlled according to the difference between the photo-reflectance of the test pattern for correction and the reference value, to compensate for the measurement error of the toner density.

When the toner density estimated by the first density estimating unit 73 is in the setting range, the storage unit 76 stores the toner density estimated by the first density estimating unit 73. When the toner density estimated by the first density estimating unit 73 is not in the setting range, the storage unit 76 stores the toner density estimated by the second density estimating unit 74. In addition, the storage unit 76 may store information on the toner density corresponding to the rate of change of the photo-reflectance according to the grayscales of the test pattern used by the second density estimating unit 74. According to the embodiment of the present invention, when a developing unit is mounted for the first time or replaced and newly mounted on an image forming apparatus, the first density estimating unit 73 sets the current toner density by using the information on the toner density stored in the storage unit 76, and is allowed to more accurately estimate the toner density for the toner supplying apparatus by using the set toner density and the consumed and supplied toner amounts measured by the measuring unit 70.

In addition, when the developing unit is first mounted on the image forming apparatus, the storage unit 76 preferably corrects the information on the toner density corresponding to the rate of change of the photo-reflectance according to the grayscales of the test pattern by using the stored toner density and the rate of change of the photo-reflectance pattern calculated by the second density estimating unit 74.

The counter unit 77 counts the number of paper sheets output from the image forming apparatus. When the number of output paper sheets reaches a predetermined value, the test pattern forming unit 71 forms a test pattern for correction, the sensor 72 senses the photo-reflectance of the test pattern for correction. The controller 75 controls the toner supply by compensating for the measurement error of the measuring unit 70 according to the result of comparison of the sensed photo-reflectance of the test pattern for correction with the reference value.

Figure 11:
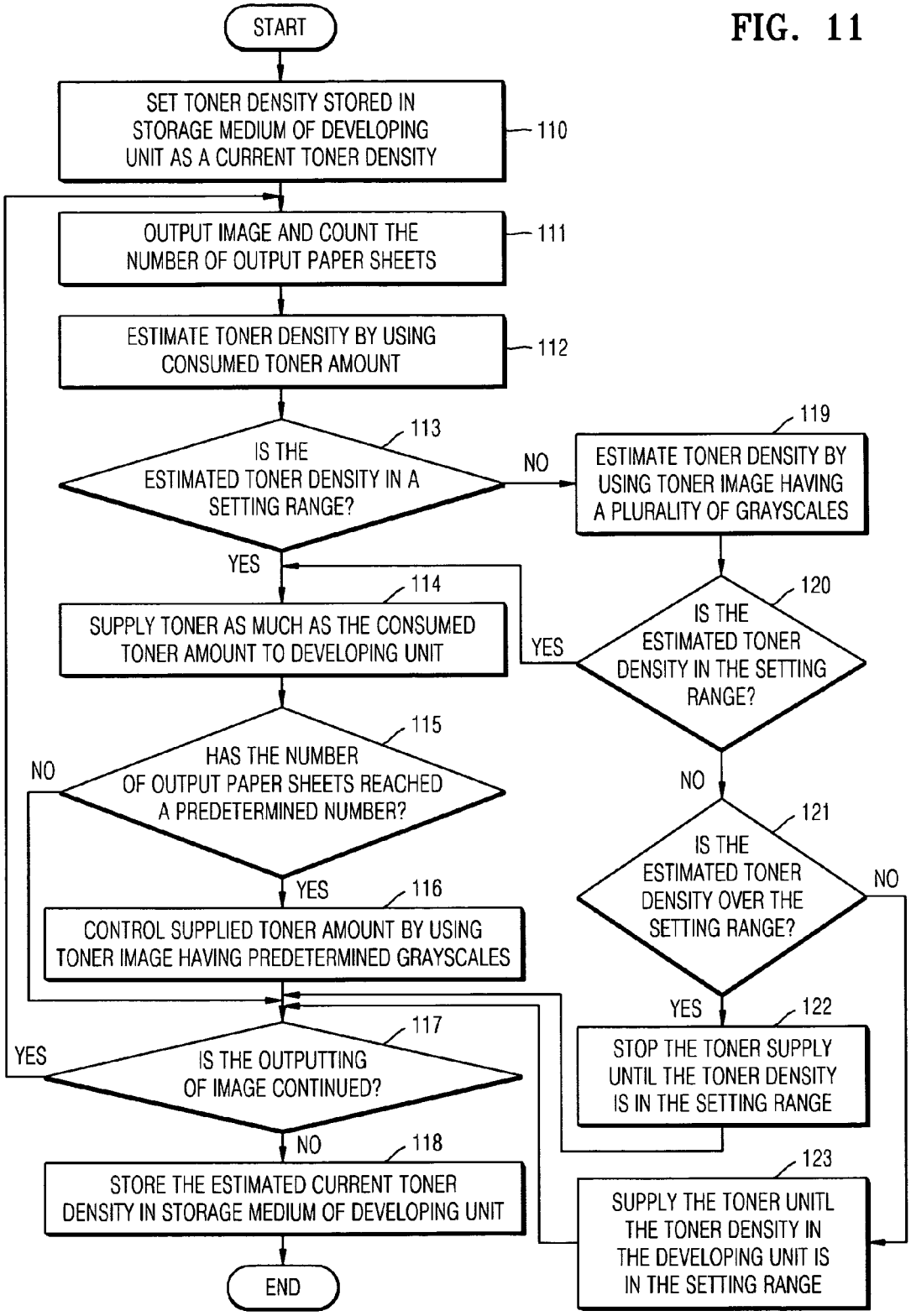
FIG. 11 is a flowchart of a toner supplying method according to an embodiment of the present invention.
Figure 12A:
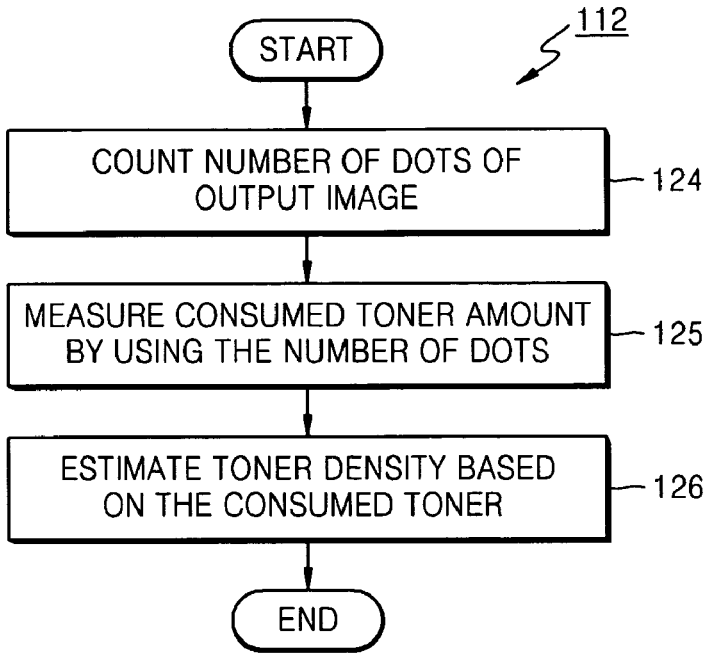
FIG. 12A is a flowchart of operation 112 shown in FIG. 11.
Figure 12B:
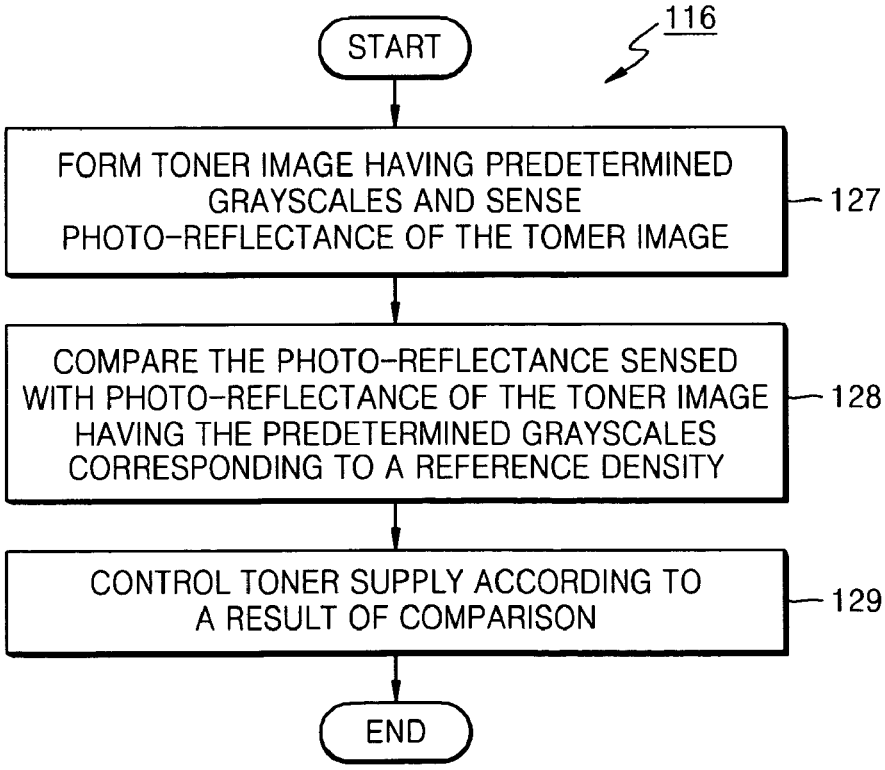
FIG. 12B is a flowchart of operation 116 shown in FIG. 11.
Figure 12C:
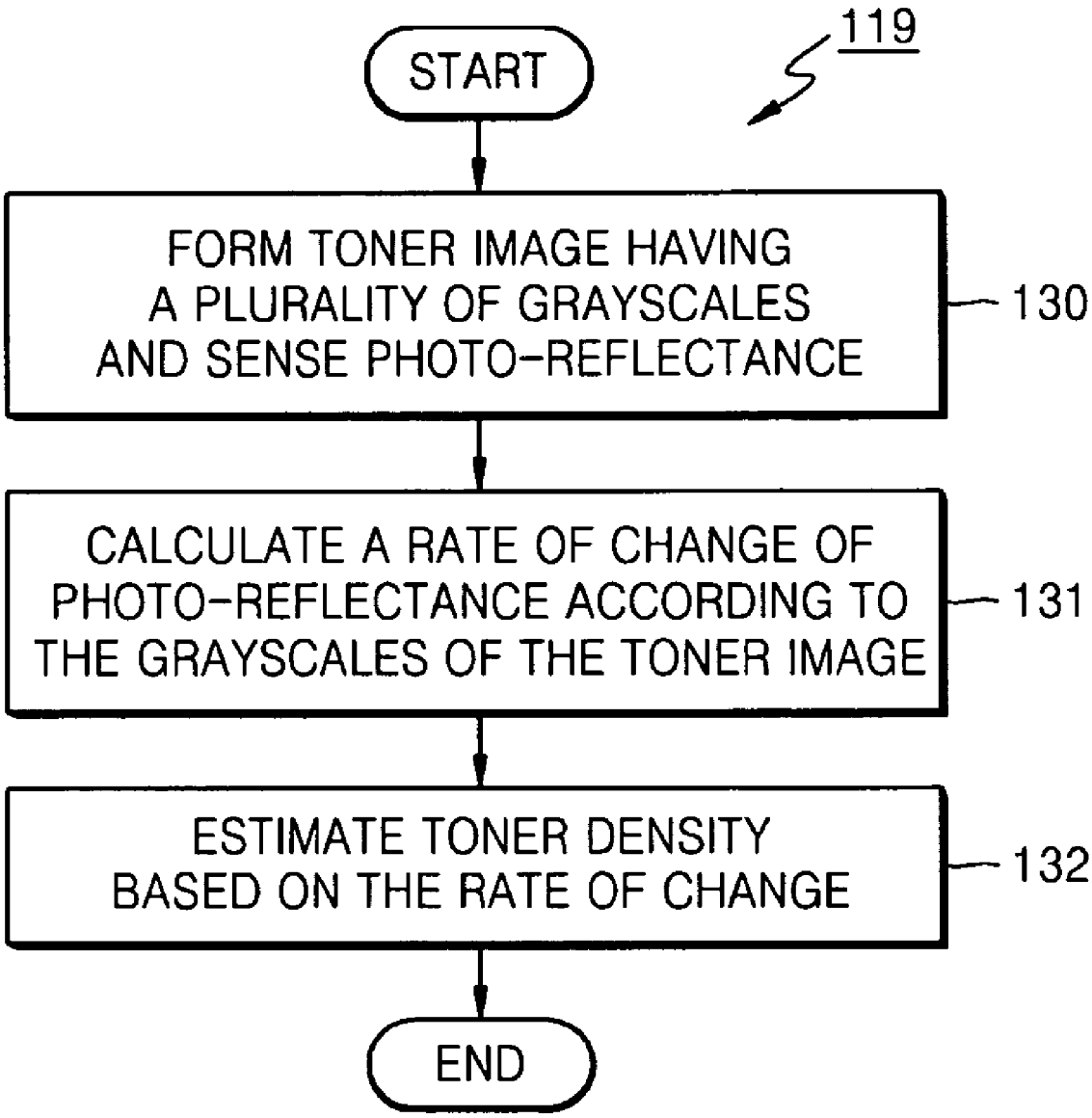
FIG. 12C is a flowchart of operation 119 shown in FIG. 11.

A toner supplying method according to an embodiment of the present invention will now be described with reference to FIGS. 11 and 12A to 12C. FIG. 11 is a flowchart of the toner supplying method according to the embodiment of the present invention. FIGS. 12A to 12C are flowcharts of operations of the toner supplying method shown in FIG. 11.

In operation 110, a toner supplying apparatus determines whether or not a developing unit is mounted on an image forming apparatus for the first time. When the developing unit is not mounted for the first time, the procedure proceeds to operation 111.

In operation 111, the toner supplying apparatus outputs images and counts the number of output paper sheets.

In operation 112, the toner supplying apparatus estimates the toner density using the consumed toner amount. FIG. 12A is a flowchart of operation 112, in which the toner density is estimated by using the consumed toner amount.

In operation 124, the toner supplying apparatus counts the number of dots of the output image and measures the consumed toner amount by using the counted number of dots. When the output image is a color image, the number of dots of each color is counted, and the consumed toner amount of each color is measured. As described above, in the toner supplying apparatus according to the embodiment of the present invention, the number of dots of the output image is counted, and the coverage of the image is calculated based on the number of dots, to measure the consumed toner amount for the output image. The coverage of an image is the ratio of the number of dots of the output image to the number of dots of the entire printing paper. As shown in FIG. 9A, the relationship between the coverage of the image and the consumed toner amount is represented by a linear equation. The toner supplying apparatus can measure the consumed toner amount based on the coverage of output image calculated by using the linear equation.

In operation 126, the toner supplying apparatus estimates the toner density using the measured consumed toner amount. Since the amount of the carrier in the developing unit is generally constant, the changed toner density can be estimated by using the consumed toner amount.

In operation 113, the toner supplying apparatus determines whether or not the toner density estimated in operation 112 is in a setting range. The setting range is the range of density in which the toner is maintained to form an image in the image forming apparatus. The setting range may be set differently according to the type of toner and the type of image forming apparatus.

In operation 113, when the toner density is determined to be in the setting range in operation 113, the toner supplying apparatus drives a toner supply motor to supply an amount of toner equal to the toner amount measured in operation 112, to the developing unit. In the toner supplying method according to the embodiment of the present invention, the operating time of the toner supply motor is controlled, so that the supplied toner amount can be easily controlled. As shown in FIG. 9B, the relationship between the operating time of the toner supply motor and the supplied toner amount is represented by a linear equation. The toner supplying apparatus sets the operating time of the toner supply motor according to the measured consumed toner amount using the linear equation, and drives the toner supply motor for the set operating time, so that an amount of toner equal to the measured toner amount can be supplied.

In operation 115, the toner supplying apparatus determines whether or not the number of output paper sheets counted in operation 111 reaches a predetermined number of paper sheets. The predetermined number of paper sheets may be set by a user. The predetermined number of paper sheets is used to compensate for the supplied toner amount by using the test pattern corresponding to the predetermined grayscales according to the predetermined number of paper sheets. When the number of output paper sheets has not reached the predetermined number of paper sheets, the procedure proceeds to operation 117 so as to determine whether or not to continue to output the image. When the number of output paper sheets has reached the predetermined number of paper sheets, the toner supplying apparatus controls the toner supply in operation 116 by using the test pattern having the predetermined grayscales formed using the toner.

FIG. 12B is a flowchart of operation 116, in which the toner supply is controlled by using the test pattern having the predetermined grayscales formed using the toner.

In operation 127, the toner supplying apparatus forms the test pattern having the predetermined grayscales using the toner and senses the photo-reflectance of the test pattern.

In operation 128, the toner supplying apparatus compares the sensed photo-reflectance with the reference value, that is, the photo-reflectance of the test pattern for correction formed with the toner having the reference density. The photo-reflectance includes normal reflecting and scattered reflecting. The photo-reflectance can be sensed by using a CTD sensor which receives the reflected light and transforms the received reflected light into electrical energy. The reference value is set in operation 110. For example, in a case where the photo-reflectance of the test pattern are sensed by the CTD sensor, the sensed photo-reflectance are the output voltage of the CTD sensor for the test pattern of correction. The photo-reflectance of the test pattern for correction formed with the toner having the reference density are the output voltage of the CTD sensor for the test pattern for correction formed with the toner having the reference density.

In operation 129, the toner supplying apparatus compensates for the supplied toner amount using the result of comparison in operation 128. According to the embodiment of the present invention, the toner supplying apparatus calculates the difference between the photo-reflectance sensed in operation 128 and the reference value. The toner supplying apparatus controls the toner supply according to the calculated difference from the reference value by using the information on the supplied toner amount corresponding to the difference from the reference values set in advance in operation 129. As described above, FIG. 10 shows the table of the corrected operating time of the toner supply motor according the difference from the reference value so as to control the toner supply according the difference between the photo-reflectance of the test pattern for correction and the reference value according to the embodiment of the present invention. In the toner supplying method according to the embodiment of the present invention, the information on the supplied toner amount corresponding to the difference from the reference value such as the table shown in FIG. 10 is stored in a memory or the like. The operating time of the toner supply motor is controlled according to the supplied toner amount corresponding to the difference from the reference value calculated in operation 128 by using the stored information to maintain the toner density at the reference density.

After the control of the toner supply is completed in operation 116, it is determined in operation 117 whether or not to continue to output the image. In the case of continuing to output the image, the procedure proceeds to operation 111 to output the next image and count the number of output paper sheets. In the case of stopping the output of the image, the toner supplying apparatus stores the current toner density estimated in operation 118 in a storage medium in the developing unit and stops outputting the image.

The case where the toner density estimated in operation 113 is not determined to be in the setting range will now be described. In this case, in operation 119, the toner supplying apparatus estimates the toner density again by using the test pattern having a plurality of grayscales. In order to determine whether or not the actual toner density in the developing unit is changed, operation 119 is performed to more accurately estimate the toner density in the developing unit by using the test pattern having a plurality of grayscales. In the toner density estimating method using operation 112, even when the toner density in the developing unit does not vary, the density of the image varies with changes in temperature, humidity, or various other external factors, so that the toner density in the developing unit cannot be accurately estimated. However, in the toner density estimating method using operation 119, the toner density in the developing unit can be accurately measured irrespective of changes in external factors.

FIG. 12C is a flowchart of operation 119, in which the toner density is estimated using the test pattern having a plurality of grayscales formed using the toner.

In operation 130, the toner supplying apparatus forms the test pattern having a plurality of grayscales using the toner, and senses the photo-reflectance of the test pattern. According to the embodiment of the present invention, the toner supplying apparatus scans the test pattern having a plurality of grayscales with light, receives reflected light, and outputs a voltage according to the intensity of the reflected light, so that it is possible to sense the photo-reflectance of the test pattern.

In operation 131, the toner supplying apparatus calculates the rate of change of the photo-reflectance according to the grayscales of the test pattern. According to the embodiment of the present invention, the toner supplying apparatus can generate a linear equation of the change of the output voltage according to the grayscales of the test pattern and calculate the rate of change of the photo-reflectance according to the grayscales of the test pattern by using the slope of the linear equation.

In operation 132, the toner supplying apparatus estimates the toner density according to the calculated rate of change. According to the embodiment of the present invention, in operation 131, the linear equation of the change of the output voltage according to the grayscales of the test pattern is generated. When the rate of change of the photo-reflectance is calculated by using the slope of the linear equation, in operation 132, the toner density can be estimated based on the rate of change calculated in operation 131 by using the information of the toner density corresponding to the slope of the output voltage with respect to the rate of change of the photo-reflectance according to the grayscales of the predetermined test pattern.

Operations 130 and 131 are similar to the toner density estimating method according to the aforementioned embodiment shown in FIG. 6, and thus, a detailed description thereof is omitted.

In operation 120, it is determined whether or not the toner density estimated in operation 119 is in the setting range. When the estimated toner density is in the setting range, the toner density in the developing unit is in a normal state, and the procedure proceeds to operation 114, so that the toner is supplied by an existing method. On the other hand, when the estimated toner density is not in the setting range, the toner supply is controlled according to the toner density estimated in operation 119.

In operation 121, it is determined whether the estimated toner density is above or below the setting range. When the estimated toner density is determined to be above the setting range, in operation 122, the toner supplying apparatus stops the toner supply until the toner density in the developing unit is in the setting range. On the other hand, when the estimated toner density is determined to be below the setting range, in operation 123, the toner supplying apparatus supplies the toner until the toner density in the developing unit is in the setting range.

After the toner supply is controlled to maintain the toner density in the developing unit in the setting range in operations 122 and 123, the toner supplying apparatus proceeds to an operation for determining whether or not to continue to output the image. As a result of the comparison, the output of the image is stopped or continued.

In a toner density estimating method and apparatus according to the present invention, since a toner density is estimated not directly from a photo-reflectance but a rate of change in the photo-reflectance, it is possible to accurately estimate the toner density even in a case where the measured value of the photo-reflectance varies with a change in temperature, humidity, charging voltage, or other external factors.

In addition, in a toner supplying method and apparatus according to the present invention, since the toner density is accurately estimated by using the rate of change of the photo-reflectance of a test pattern, it is possible to monitor an abnormal state in which the photo-reflectance of the test pattern vary with external factors and to prevent the toner from being over-supplied or under-supplied even in the abnormal state, so that the toner density can be maintained at a uniform level.

In addition, in a toner supplying method and apparatus according to the present invention, since consumed and supplied toner amounts are compensated by using a test pattern having predetermined grayscales, the toner density can be maintained at a uniform level in spite of an abnormal state.

While the present invention has been particularly shown and described with reference to exemplary embodiments thereof, it will be understood by those skilled in the art that various changes in form and detail may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A toner density estimating method for estimating toner density of toner on a developing unit of an image forming apparatus, comprising:

(a) sensing photo-reflectance of a test pattern having a plurality of grayscales formed from toner on a surface of the developing unit;

(b) calculating a rate of change of the photo-reflectance according to the plurality of grayscales of the test pattern; and (c) estimating a toner density based on the rate of change.

2. The toner density estimating method of claim 1, wherein the plurality of grayscales are formed on an intermediate transfer belt of the developing unit.

3. The toner density estimating method of claim 1, further comprising forming the test pattern having a plurality of grayscales using the toner.

4. The toner density estimating method of claim 1, wherein step (b) comprises:

generating a linear equation of the change of the photo-reflectance according to the plurality of grayscales of the test pattern; and calculating the rate of change by using a slope of the linear equation.

5. The toner density estimating method of claim 1, wherein in step (c), the toner density corresponding to the rate of change is estimated by using information of a toner density corresponding to predetermined photo-reflectance.

6. The toner density estimating method of claim 5, further comprising storing the information of the toner density in a storage medium provided in the developing unit which supplies the toner.

7. The toner density estimating method of claim 6, wherein the information of the toner density corresponding to the rate of change of the photo-reflectance is stored in the storage medium.

8. The toner density estimating method of claim 6, further comprising correcting the information on the toner density corresponding to the rate of change of the photo-reflectance by using the stored toner density and the calculated rate of change.

9. A toner supplying method comprising:

(a) measuring consumed and supplied toner amounts and estimating a toner density on a developing unit of an image forming apparatus by using consumed and supplied toner amounts;

(b) sensing photo-reflectance of a test pattern having a plurality of grayscales formed from the toner according to whether or not the toner density estimated in (a) is in a setting range, wherein the plurality of grayscales are formed on a surface of the developing unit;

(c) estimating the toner density based on a rate of change of the photo-reflectance according to the plurality of grayscales of the test pattern; and (d) supplying the toner according to the toner density estimated in step (c).

10. The toner supplying method of claim 9, further comprising, when the toner density estimated in step (a) is in the setting range, storing information on the toner density estimated in step (a) in a storage medium provided in the developing unit, and when the toner density estimated in step (c) is in the setting range, storing information on the toner density estimated in step (c) in the storage medium.

11. The toner supplying method of claim 10, further comprising setting a current toner density by using the stored information of the toner density.

12. The toner supplying method of claim 9, further comprising:

(e) when the toner density estimated in step (a) is in the setting range, sensing photo-reflectance of a test pattern having predetermined grayscales formed by using the toner; and controlling toner supply according to a result of a comparison of the photo-reflectance with a reference value, wherein the reference value is a photo-reflectance of the test pattern having the predetermined grayscales corresponding to a reference density.

13. The toner supplying method of claim 12, further comprising:

(f) calculating a difference between the sensed photo-reflectance and the reference value; and controlling the toner supply according to the difference by using information of the supplied toner amount corresponding to a difference between the reference value.

14. A computer-readable recording medium having embodied thereon a program for a toner density estimating method for estimating toner density of toner on a developing unit of an image forming apparatus comprising:

(a) sensing photo-reflectance of a test pattern having a plurality of grayscales formed from toner on a surface of the developing unit;

(b) calculating a rate of change of the photo-reflectance according to the plurality of grayscales of the test pattern; and (c) estimating a toner density based on the rate of change.

15. A toner density estimating apparatus comprising:

a sensor for sensing photo-reflectance of a test pattern having a plurality of grayscales formed from toner where the test pattern is formed on a surface of a developing unit of an image forming apparatus; and a density estimating unit for estimating a toner density based on a rate of change of the photo-reflectance according to the plurality of grayscales of the test pattern.

16. The toner density estimating apparatus of claim 15, further comprising a test pattern forming unit for forming the test pattern having a plurality of grayscales from the toner.

17. The toner density estimating apparatus of claim 15, further comprising a storage unit for storing information of the toner density corresponding to a predetermined rate of change of the photo-reflectance, wherein the density estimating unit estimates the toner density corresponding to the rate of change by using information of the toner density corresponding to the rate of change of the photo-reflectance.

18. The toner density estimating apparatus of claim 17, wherein the storage unit is provided in the developing unit to which the toner is supplied, and wherein the storage unit stores the estimated toner density and corrects the information of the toner density corresponding to a rate of change of the photo-reflectance by using the stored information on the toner density and the calculated rate of change.

19. A toner supplying apparatus, comprising:

a measuring unit for measuring consumed and supplied toner amounts;

a first density estimating unit for estimating a toner density by using a result of measurement by the measuring unit;

a test pattern forming unit for forming a test pattern having a plurality of grayscales by using the toner, wherein the test pattern is formed on a surface of a developing unit of an image forming apparatus;

a sensor for sensing photo-reflectance of the test pattern having a plurality of grayscales;

a second density estimating unit for estimating the toner density based on a rate of change of the photo-reflectance according to the grayscales of the test pattern; and a controller for controlling toner supply according to the densities of toner estimated by the first and second estimating units.

20. The toner supplying apparatus of claim 19, wherein when the toner density estimated by the first density estimating unit is in a setting range, the controller controls the toner supply according to the toner density estimated by the first density estimating unit, and wherein when the toner density estimated by the first density estimating unit is not in a setting range, the controller controls the toner supply according to the toner density estimated by the second density estimating unit.

21. The toner supplying apparatus of claim 19, wherein the test pattern forming unit forms a test pattern having predetermined grayscales from the toner, wherein the sensor senses photo-reflectance of the formed test pattern having the predetermined grayscales, and wherein the controller controls the toner supply according to a result of comparison of the sensed photo-reflectance of the test pattern having the predetermined grayscales with photo-reflectance of the test pattern having the predetermined grayscales corresponding to a reference density.

* * * * *